US010024599B2

(12) United States Patent
Safavi

(10) Patent No.: US 10,024,599 B2
(45) Date of Patent: Jul. 17, 2018

(54) LABORATORY CONSUMABLE DRYING DEVICE

(71) Applicant: GRENOVA, LLC, Richmond, VA (US)

(72) Inventor: Ali Safavi, Chester, VA (US)

(73) Assignee: GRENOVA, LLC, Richmond, VA (US)

( * ) Notice: Subject to any disclaimer, the term of this patent is extended or adjusted under 35 U.S.C. 154(b) by 706 days.

(21) Appl. No.: 14/575,374

(22) Filed: Dec. 18, 2014

(65) Prior Publication Data

US 2015/0168065 A1 Jun. 18, 2015

Related U.S. Application Data

(60) Provisional application No. 61/917,821, filed on Dec. 18, 2013.

(51) Int. Cl.
*F26B 3/00* (2006.01)
*F26B 21/12* (2006.01)
(Continued)

(52) U.S. Cl.
CPC ..... *F26B 21/12* (2013.01); *F26B 3/06* (2013.01); *F26B 5/00* (2013.01); *F26B 9/066* (2013.01);
(Continued)

(58) Field of Classification Search
CPC ..... F26B 21/12; F26B 21/003; F26B 25/18; F26B 21/006; F26B 3/06; F26B 3/22;
(Continued)

(56) References Cited

U.S. PATENT DOCUMENTS 2,548,363 A * 4/1951 Gray ..... F26B 21/006 34/104
4,268,973 A * 5/1981 Jezuit ..... A47L 15/486 211/69.8
(Continued)

FOREIGN PATENT DOCUMENTS

EP 0919282 A1 6/1999
WO 2013064862 A1 5/2013

OTHER PUBLICATIONS

PCT International Search Report and Written Opinion for PCT/US2014/071279, dated Mar. 30, 2015, 11 pages.

*Primary Examiner* — Kenneth Rinehart
*Assistant Examiner* — Bao D Nguyen
(74) *Attorney, Agent, or Firm* — Patent Law of Virginia, PLLC; Brian J. Teague

(57) ABSTRACT

A drying device includes a first compartment configured to removably receive a drying chamber. The drying chamber includes a tray capable of receiving one or more racks that are configured to hold a plurality of laboratory consumables. The first compartment includes one or more pistons capable of displacing the tray to agitate the laboratory consumables. A second compartment is attached to the first compartment. The second compartment includes one or more air flow sources for directing a flow of air to the plurality of laboratory consumables and an air filter located proximate to the one or more air flow sources. A method of drying laboratory consumables is also disclosed.

26 Claims, 4 Drawing Sheets

(51) Int. Cl.

| | |
|---|---|
| ***F26B 21/00*** | (2006.01) |
| ***F26B 25/18*** | (2006.01) |
| ***F26B 3/06*** | (2006.01) |
| ***F26B 5/00*** | (2006.01) |
| ***F26B 9/06*** | (2006.01) |
| ***F26B 9/08*** | (2006.01) |
| ***F26B 25/04*** | (2006.01) |
| ***F26B 25/06*** | (2006.01) |

(52) U.S. Cl.
CPC ..... *F26B 9/082* (2013.01); *F26B 21/003* (2013.01); *F26B 21/006* (2013.01); *F26B 25/04* (2013.01); *F26B 25/066* (2013.01); *F26B 25/18* (2013.01)

(58) Field of Classification Search
CPC ..... F26B 5/00; F26B 9/00; F26B 9/08; F26B 9/082; F26B 25/04; F26B 9/066
USPC ... 34/487, 82, 104, 106, 184, 185, 262, 397, 34/401, 179, 164
See application file for complete search history.

(56) References Cited

U.S. PATENT DOCUMENTS 5,010,660 A * 4/1991 Hambleton ..... B08B 9/28 34/104
6,041,515 A * 3/2000 Ally ..... B01L 3/5025 34/230
6,230,875 B1 * 5/2001 Carlyle ..... B65G 27/22 198/761

* cited by examiner

LABORATORY CONSUMABLE DRYING DEVICE

CROSS-REFERENCE TO RELATED APPLICATIONS

This application claims the benefit of U.S. Provisional Patent Application Ser. No. 61/917,821, filed Dec. 18, 2013, which is hereby incorporated by reference in its entirety.

FIELD

The present technology relates to a drying device and a method of drying laboratory consumables, and more particularly to a pipette tip drying device and a method of washing pipette tips.

BACKGROUND

Every year around 4,000,000 pounds of plastic pipette tips, after a single use, are disposed of in landfills globally, leading to significant environmental pollution and costs. A typical laboratory consumes several thousand pipette tips daily for samples and assay procedures. Due to the lack of options for cleaning plastic consumables, the labs discard pipette tips after each use. Such high consumption of plastic tips adds $25,000-$1.5 M to the annual operation cost to each of the approximately 14,000 research laboratories in the US.

Devices that are capable of efficient pipette tip cleaning and sterilization could save businesses substantial amounts of money in their scientific operations and drastically reduce the amount of waste produced in the course of operations. Few devices have been developed for this purpose to date. In some cases, laboratories have developed small-scale cleaning methods to reuse a few pipette tips, such as single 96-tip cases. In some small-scale automatic liquid handling instruments, there are setups for the cleaning of tips with solutions. Neither of these options, however, is large enough in scale to be useful in a large industrial, government, or academic laboratory that may use hundreds of pipette tips every day. Additionally, labs must have absolute confidence that a cleaning system has completely removed all contaminants from the pipette tips so that there is no carryover, a term for the contamination presented into an experiment by equipment used in a prior experiment.

Another issue related to large scale washing and sterilization of laboratory consumables is ensuring that the laboratory consumables are completely dried and ready for use subsequent to the cleaning process to avoid fluid contamination of the sample. As solutions for the large scale washing problem are scarce, so too are large scale drying solutions.

Thus, there is a need for a large-scale method for drying pipette tips so they may be reused in large-scale laboratory processes.

SUMMARY

The present technology provides a number of advantages including providing a device and method for the efficient drying, after a sterilizing wash, of a large number of laboratory consumables, such as pipette tips, for use in large scale laboratory settings. Efficient drying of laboratory consumables is made possible as the device allows for direct insertion of the racks holding the consumables, eliminating the need to transfer the laboratory consumables individually for drying. The device allows for insertion of large quantity of laboratory consumables, which also provides for efficiency in a large scale laboratory setting. Additionally, the device advantageously combines agitation and air flow to provide effective and complete drying of the laboratory consumables.

One embodiment of this invention relates to a drying device that includes a first compartment configured to removably receive a drying chamber. The drying chamber includes a tray capable of receiving one or more racks that are configured to hold a plurality of laboratory consumables. The first compartment includes one or more pistons capable of displacing the tray to agitate the laboratory consumables. A second compartment is attached to the first compartment. The second compartment includes one or more air flow sources for directing a flow of air to the plurality of laboratory consumables and an air filter located proximate to the one or more air flow sources.

Another embodiment of this invention relates to a method for drying laboratory consumables that includes inserting one or more racks holding a plurality of laboratory consumables into a drying chamber having a tray capable of receiving the one or more racks. The drying chamber is inserted into a first compartment of a drying device. The first compartment is configured to removably receive the drying chamber. A flow of air is directed to the plurality of laboratory consumables from a second compartment attached to the first compartment. The second compartment includes one or more air flow sources for directing the flow of air to the laboratory consumables and an air filter located proximate to the one or more air flow sources. The tray is displaced one or more times using one or more pistons located within the first compartment to agitate the plurality of laboratory consumables.

DETAILED DESCRIPTION

Figure 2:
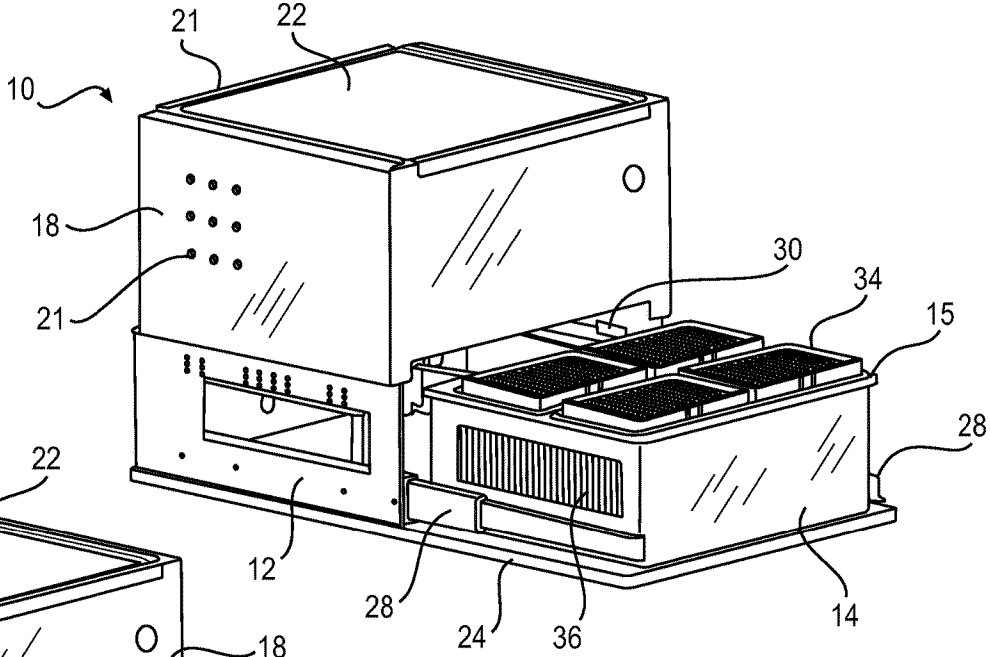
FIG. 2 is a perspective view of the exemplary embodiment of the laboratory consumables drying device of the present disclosure as illustrated in FIG. 1 with a drying chamber removed from a first compartment of the drying device.

An exemplary laboratory consumable drying device 10 is illustrated in FIGS. 1-5. Drying device 10 is configured to substantially remove fluids from laboratory consumables inserted therein. The drying device 10 includes a first compartment 12, a drying chamber 14, drying tray 15, pistons 16, a second compartment 18, an air flow sources 20A and 20B, air filter insert 21, a filter 22, and a drip pan 24, although the drying device 10 may include other elements in other configurations. This exemplary technology includes a number of advantages including providing a device and method for the efficient drying, after sterilization, of a large number of laboratory consumables, such as pipette tips, for use in large scale laboratory settings.

Referring to FIGS. 1-5, the exemplary drying device includes first compartment 12. First compartment 12 is sized and configured to removably receive drying chamber 14 through an opening in first compartment 12. First compartment 12 may have various sizes and configurations depending on the size and configuration of the drying chamber that is inserted therein. In this example, first compartment 12 is constructed of stainless steel, although other materials, such as other metals or plastics, may be utilized for first compartment 12.

Figure 3:
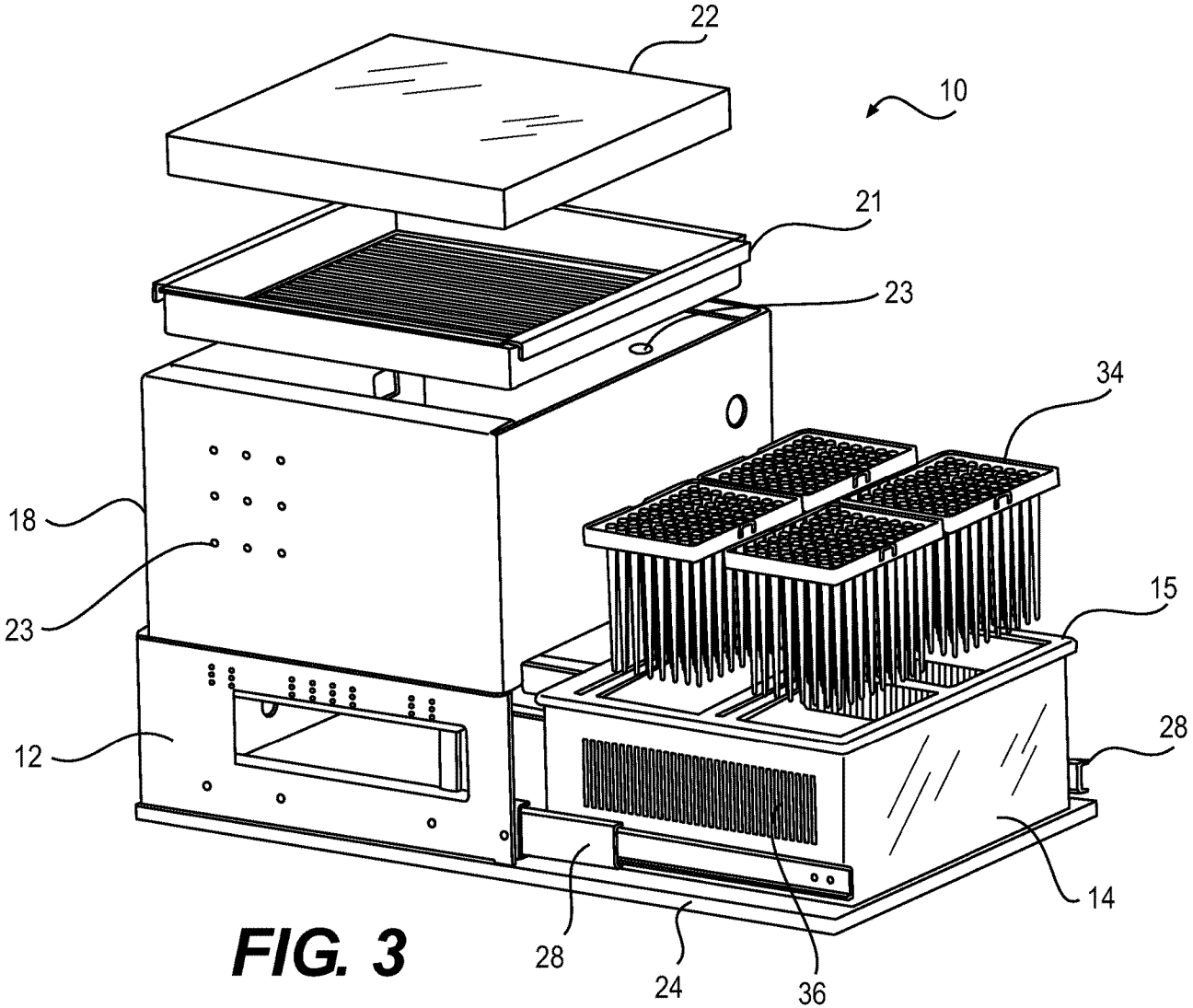
FIG. 3 is a partially exploded perspective view of the exemplary embodiment of the laboratory consumables drying device of the present disclosure as illustrated in FIG. 2 with one or more tip racks removed from the drying chamber.
Figure 4:
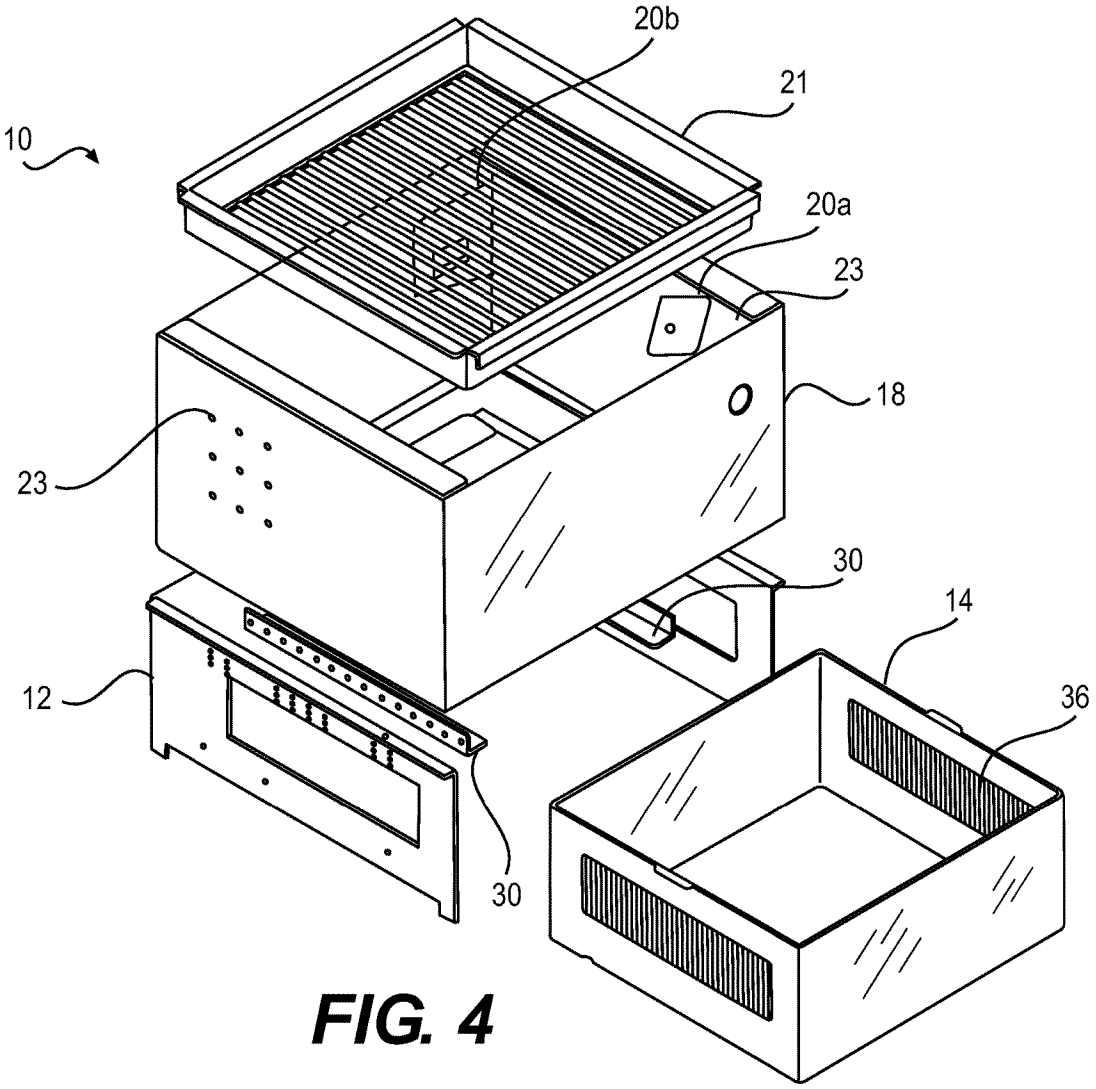
FIG. 4 is an exploded perspective view of the exemplary embodiment of the laboratory consumables drying device of the present disclosure as illustrated in FIG. 1

First compartment 12 includes rails 28 attached to opposing inner walls. In this example, rails 28 are telescoping arms secured to drying chamber 14 such that drying chamber 14 may be inserted and removed from first compartment 12, although other types of rails in other configurations may be utilized for first compartment 12 to removably receive drying chamber 14. Drying chamber 14 may be slidably removed from first compartment 12 along rails 28 as illustrated in FIGS. 2 and 3. Referring now to FIG. 4, first compartment 12 may also include mounting brackets 30 located on opposing side walls to further guide the insertion of drying chamber 14 into first compartment 12. Referring again to FIGS. 1-5, first compartment 12 also includes openings 30 located on opposing sidewalls that permit airflow into first compartment 12.

Figure 1:
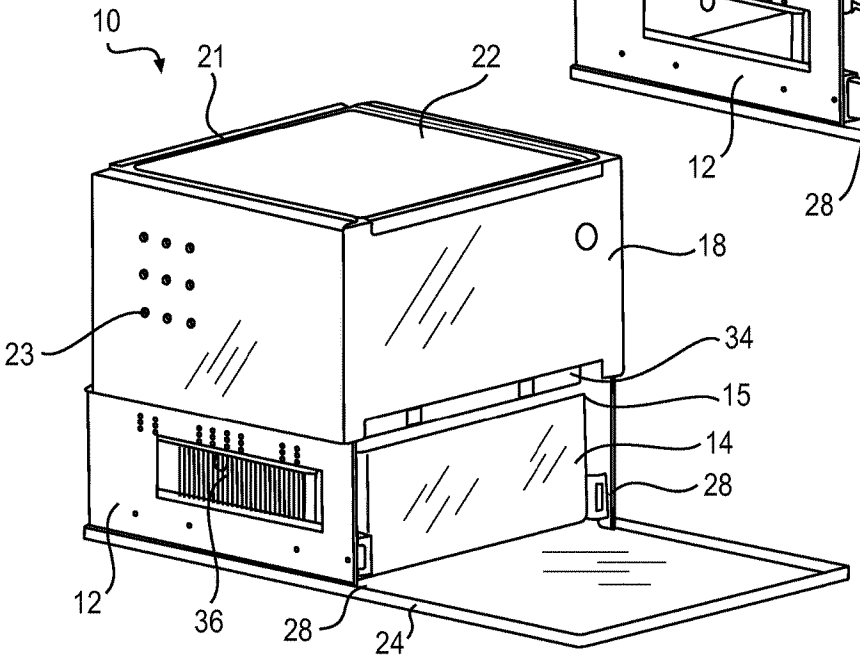
FIG. 1 is a perspective view of an exemplary embodiment of a laboratory consumables drying device of the present disclosure.

Drying chamber 14 is configured to be removably inserted into first compartment 12 as shown in FIG. 1. Drying chamber 14 is constructed of stainless steel, although drying chamber 14 may be constructed of other materials, such as other metals or plastics, in different combinations. Drying chamber 14 includes drying tray 15, which may be removably attached to drying chamber 14. In this example, drying tray 15 is configured to rest on top of drying chamber 14, although drying tray 14 may be removably attached to drying chamber 14 at other locations using other attachment mechanisms.

Drying tray 15 is configured to receive one or more racks 34 configured to hold a plurality of laboratory consumables, such as disposable pipette tips, as illustrated in FIG. 2. Racks 34 allow the laboratory consumables to extend into drying chamber 14. Although four racks 34 are illustrated, it is to be understood that drying tray 15 could be configured to receive other numbers of racks 34 holding laboratory consumables. By way of example 1, 2, 8, 16 or more racks 34 may be utilized for maximization of the throughput in the space available in drying chamber 14. In this example, racks 34 are each tip rack trays configured to hold up to 96 pipette tips for a total of 384 pipette tips in drying chamber 14, although racks 34 may hold other numbers of pipette tips, or other laboratory consumables. Drying tray 15 may, by way of example, hold tip rack trays with a total number of pipette tips of 24, 48, 96, 384, or 1536, although drying tray 15 may hold other numbers or types of laboratory consumables.

Drying chamber 14 also includes vents 36 located on opposing sidewalls, although vents 36 may include more or fewer vents located in other areas along drying chamber 14 in other configurations. In this example, vents 36 are configured as gratings that may be aligned with openings 32 in first compartment 12 to permit air flow between drying chamber 14 and the external environment.

Figure 5:
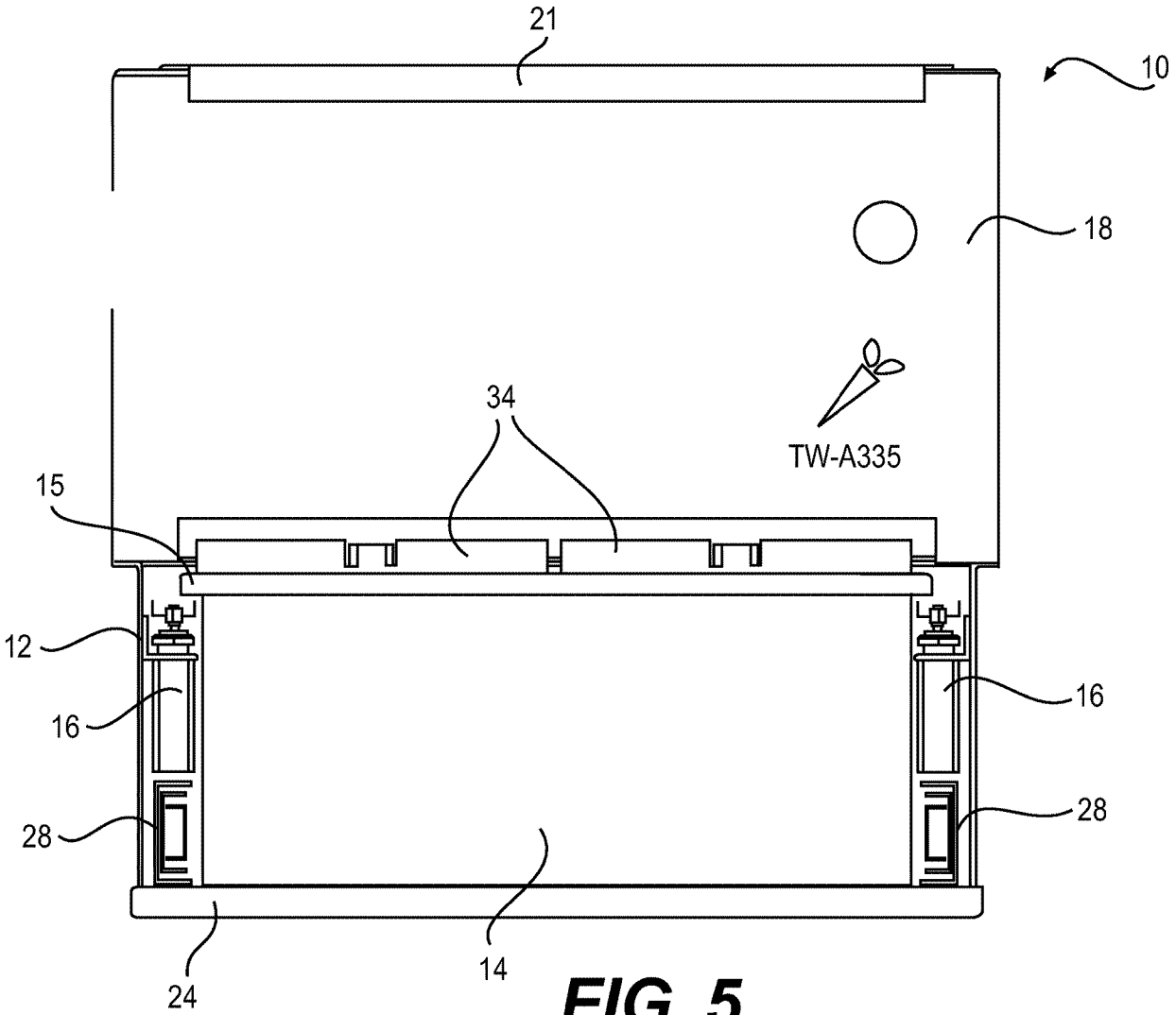
FIG. 5 is a front design view of the exemplary embodiment of the laboratory consumables drying device of the present disclosure as illustrated in FIG. 1

Referring now to FIG. 5, pistons 16 located in first compartment 12 are configured to displace drying tray 15 when drying chamber 14 is inserted into first compartment 12. Pistons 16 are configured to briefly grab, lift, and release drying tray 15 from drying chamber 14 to agitate the laboratory consumables held in racks 34, although other elements in other configurations may be utilized to agitate the laboratory consumables.

Referring again to FIGS. 1-5, drying device 10 includes second compartment 18 attached to first compartment 12. In this example, second compartment 18 sits on top of first compartment 12, although the compartments may be configured in other arrangements. In this example, second compartment 18 is constructed of stainless steel, although second compartment 12 may be constructed of other materials, such as other metals, or plastics.

Second compartment 18 includes one or more air flow sources 20A and 20B arranged therein as illustrated in FIG. 4, although drying device 10 may include other numbers of air flow sources in other locations, such as in first compartment 12 or on the outside of drying device 10. Air flow sources 20A and 20B are arranged to direct a flow of air to the plurality of laboratory consumables held in drying chamber 14. Air flow source 20A, for example, is located on a sidewall of the second compartment 18 in line with an open port/vent, such as air ports 23, in order to air external to drying device 10 toward the laboratory consumables located in drying device 10. By way of example, air flow source 20B is located in second compartment 18 beneath air filter insert 21. The air flow sources 20A and 20B may be arranged to direct an air flow parallel to the laboratory consumables, although air flow sources 20A and 20B may be arranged to direct air flow in other directions, such as perpendicular to the axes of the laboratory consumables. Air flow sources 20A and 20B may be heating fans or sources of compressed pressurized air, by way of example, although other sources of air that may be directed to the laboratory consumables may be utilized.

Second compartment 18 also includes air filter insert 21 configured to be removably attached located on the top surface of second compartment 18. In this example, air filter insert 21 is a grating configured to receive air filter 22 therein. Air filter insert 21 is constructed of stainless steel, although other materials, such as other metals or plastics, may be utilized for air filter insert 21. Air filter 22 is configured to be inserted into air filter insert 21 and may be a charcoal input HIPAA filter, although other types of air filters may be utilized. Air filter 22 is positioned on air filter insert 21 to be located proximate to the one or more air flow sources 20. Although air filter 22 is illustrated, drying device 10 may include other air filters in other locations.

Drip pan 24 is coupled to first compartment 12 to collect fluids removed from the laboratory consumables. In this example, drip pan 24 is located below first compartment 12 and extends out a distance to accommodate drying chamber 14 when drying chamber 14 is removed from first compartment 12 as illustrated in FIGS. 2 and 3. Drip pan 24 is constructed of stainless steel, although other materials, such as other metals or plastics, may be utilized for drip pan.

A method for drying laboratory consumables, such as pipette tips, using the drying device 10 will now be described with reference to FIGS. 1-5. One or more racks 34 containing laboratory consumables, such as pipette tips by way of example, are loaded into drying chamber 14 of drying device 10 when drying chamber 14 is extended out of first compartment 12 as illustrated in FIGS. 2 and 3. As noted above, drying device 10 may utilized for other laboratory consumables. FIG. 3 shows racks 34 holding pipette tips prior to insertion into drying tray 15.

Racks 34 are supported in drying chamber 14 by drying rack 15 as illustrated in FIG. 2. Racks 34 may hold a total of 24, 48, 96, 384, or 1536 pipette tips, by way of example, although racks 34 may hold other numbers of pipette tips. The drying device 10 may be utilized with pipette tips with volumes of 10 μL-5 mL, such as 10 μL, 50 μL, 1 mL, or 5 mL pipettes, by way of example, with corresponding lengths between 30 mm-120 mm. Drying device 10 may be utilized to accommodate pipette tips of varying sizes and configurations, and may be utilized to dry both conductive and non-conductive pipette tips. The laboratory consumables may be inserted into drying device 10 after being cleaned in a washing device, such as the device disclosed in U.S. patent application Ser. No. 14/266,330, which was filed Apr. 30, 2014, the disclosure of which is incorporated herein by reference in its entirety.

Next, drying chamber 14 is inserted into first compartment 12 as illustrated in FIG. 1. By way of example, drying chamber 14 may be inserted utilizing rails 28, such as telescoping arms, located on opposing sidewalls of first compartment 12. Insertion of drying chamber 14 may further be assisted by mounting brackets 30 on the opposing inside walls of first compartment 12.

With the drying chamber 14 inserted into first compartment 12 as illustrated in FIG. 1, a flow of air is directed from air flow sources 20 in second compartment 18 to the laboratory consumables. Air flow sources 20 may include heating fans or sources of compressed pressurized air, by way of example. By way of example only, air flow sources 20 may be arranged to direct the air flow parallel to the laboratory consumables, although air flow sources 20 may be arranged to direct the air flow in other directions, such as perpendicular to the axes of the laboratory consumables.

Air flow circulating in drying device 10 is allowed to leave drying device 10 through vents 36 in drying chamber 14, which are aligned with openings 32 in first compartment 12 when drying chamber 14 is fully inserted therein. Air flow may alternatively leave drying device 10 through other vents in other locations. Air filter 22, such as a charcoal input HIPAA filter, which is inserted into air filter insert 21, is located proximate to air flow sources 20 and captures particles to maintain sterilization of the laboratory consumables during the drying process.

Drying rack 15 is then displaced using pistons 16 located within first compartment 12 as illustrated in FIG. 5. Pistons 16 grab, briefly lift, and then release drying rack 15 to agitate the laboratory consumables, although other methods of agitating the laboratory consumables may be utilized. Agitation of the laboratory consumables removes any excess droplets of fluid from the laboratory consumables. The combination of the air flow from air flow sources 20 and the agitation using pistons 16 serves to substantially remove any fluids from the laboratory consumables. During the drying process, excess fluid removed from the laboratory consumables is collected by drip pan 24.

Accordingly, the present technology provides a device and method for efficiently drying a large number of laboratory consumables subsequent to washing and prior to reuse. This device and method advantageously provide for reusing the laboratory consumables to avoid waste.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A drying device comprising:

a first compartment configured to removably receive a drying chamber via two rails affixed to opposing inner surfaces of the first compartment and opposing outer surfaces of the drying chamber, the drying chamber comprising four vertical walls and a tray removably mounted on the vertical walls, the tray having a plurality of openings defined therein, each opening capable of receiving a respective one of a plurality of racks, each rack configured to hold a plurality of laboratory consumables hanging down therefrom such that the laboratory consumables extend into the drying chamber, wherein the first compartment comprises one or more pistons capable of displacing the tray to agitate the laboratory consumables; and one or more air flow sources for directing a flow of air to the plurality of laboratory consumables and an air filter located proximate to the one or more air flow sources.

2. The device of claim 1, wherein the drying device is a device for drying pipette tips.

3. The device of claim 2, wherein the plurality of laboratory consumables comprise a plurality of pipette tips.

4. The device of claim 3, wherein the tray comprises a tip rack tray capable of receiving one or more tip racks and the plurality of pipette tips.

5. The device of claim 2, wherein the tip rack tray is configured to hold 24, 48, 96, 384, or 1536 pipette tips.

6. The device of claim 1, wherein the one or more air flow sources comprise one or more heating fans or one or more sources of compressed pressurized air.

7. The device of claim 1, wherein the air flow sources direct the flow of air in a direction parallel to the laboratory consumables.

8. The device of claim 1, wherein the drying chamber and first compartment further comprise one or more air vents which are in an aligned configuration when the drying chamber is inserted into the first compartment.

9. The device of claim 1, further comprising:

a drip pan coupled to the first compartment, the drip pan configured to collect fluids removed from the plurality of laboratory consumables.

10. The device of claim 1, wherein the drying device is configured to remove fluids from the plurality of laboratory consumables.

11. The drying device of claim 1, further comprising:

a second compartment attached to the first compartment;

wherein the one or more air flow sources and the air filter located proximate to the one or more air flow sources are located in the second compartment.

12. The drying device of claim 1, wherein the tray is capable of removably receiving one or more racks configured to hold a plurality of laboratory consumables.

13. The drying device of claim 1, wherein the tray is capable of receiving two or more racks each configured to hold a plurality of laboratory consumables.

14. A method for drying laboratory consumables, comprising:

inserting one or more racks each holding a plurality of laboratory consumables into a drying chamber of a drying device, the drying chamber comprising four vertical walls and a tray removably mounted on the vertical walls, the tray having a plurality of openings defined therein, each opening capable of receiving a respective one of the one or more racks, each of the one or more racks configured to hold its plurality of laboratory consumables hanging down therefrom such that the laboratory consumables extend into the drying chamber;

inserting the drying chamber into a first compartment of the drying device, the first compartment configured to removably receive the drying chamber via two rails affixed to opposing inner surfaces of the first compartment and opposing outer surfaces of the drying chamber;

directing a flow of air to the plurality of laboratory consumables from one or more air flow sources for directing the flow of air to the laboratory consumables and through an air filter located proximate to the one or more air flow sources; and displacing the tray one or more times using one or more pistons located with the first compartment to agitate the plurality of laboratory consumables.

15. The method of claim 14, wherein the drying device is a device for drying pipette tips.

16. The method of claim 15, wherein the plurality of laboratory consumables comprise a plurality of pipette tips.

17. The method of claim 16, wherein the tray comprises a tip rack tray capable of receiving one or more tip racks and the plurality of pipette tips.

18. The method of claim 17, wherein the tip rack tray is configured to hold 24, 48, 96, 384, or 1536 pipette tips.

19. The method of claim 14, wherein the one or more air flow sources comprises one or more heating fans or one or more sources of compressed pressurized air.

20. The method of claim 14, wherein the directing comprises directing the flow of air in a direction parallel to the laboratory consumables.

21. The method of claim 14, wherein the drying chamber and first compartment further comprise one or more air vents which are in an aligned configuration when the drying chamber is inserted into the first compartment.

22. The method of claim 14 further comprising:

collecting fluids removed from the plurality of laboratory consumables in a drip pan coupled to the first compartment.

23. The method of claim 14, wherein the directing the air flow and the displacing the tray remove fluids from the plurality of laboratory consumables.

24. The method of claim 14, wherein directing the flow of air to the plurality of laboratory consumables from one or more air flow sources comprises directing a flow of air to the plurality of laboratory consumables from a second compartment attached to the first compartment, the second compartment comprising the one or more air flow sources for directing the flow of air to the laboratory consumables and the air filter located proximate to the one or more air flow sources.

25. The method of claim 14, wherein the tray is capable of removably receiving one or more racks configured to hold a plurality of laboratory consumables.

26. The method of claim 14, wherein inserting one or more racks holding a plurality of laboratory consumables comprises inserting two or more racks each configured to hold a plurality of laboratory consumables.

* * * * *